United States Patent [19]

Cherry

[11] 4,191,436

[45] Mar. 4, 1980

[54] CABINET FOR USE IN MOBILE VEHICLE

[75] Inventor: Richard S. Cherry, Don Mills, Canada

[73] Assignee: The Streakers International Incorporated, Toronto, Canada

[21] Appl. No.: 927,876

[22] Filed: Jul. 25, 1978

[51] Int. Cl.[2] ..... A47B 43/00; A47B 88/00

[52] U.S. Cl. ..... 312/293; 312/330 R; 312/333; 312/257 SK

[58] Field of Search ..... 312/293, 330 R, 346, 312/333, 348, 209, 257 SK, 260, 261; 220/72; 248/188.4

[56] References Cited

U.S. PATENT DOCUMENTS

| | | | |
|---|---|---|---|
| 2,455,417 | 12/1948 | Holan et al. | 312/293 |
| 2,572,081 | 10/1951 | Wallance | 312/346 |
| 2,614,022 | 10/1952 | Kurtzon | 312/348 |
| 3,251,460 | 5/1966 | Edmonds | 220/72 |
| 3,386,784 | 6/1968 | Oppenhuizen et al. | 312/348 |
| 3,738,726 | 6/1973 | Burst et al. | 312/330 R |
| 3,782,800 | 1/1974 | Remington et al. | 312/333 |
| 3,960,352 | 6/1976 | Plattner et al. | 248/188.4 |
| 3,973,814 | 8/1976 | Entrikin | 312/348 |
| 4,112,539 | 9/1978 | Hagen | 312/330 R |

FOREIGN PATENT DOCUMENTS

| | | | |
|---|---|---|---|
| 1458524 | 11/1966 | France | 312/348 |

*Primary Examiner*—Victor N. Sakran

[57] ABSTRACT

A cabinet, for use in a mobile van or truck, comprising a frame with at least one pair of opposed drawer suspension assemblies each having an extensible runner with a plurality of hooks, and a tray with a horizontal bar fixed to each end of the tray in spaced relationship with the tray end. The bars are engagable with the hooks whereby the tray is removably carried on the frame as a drawer. A releasable latch holds the tray in closed position in the frame.

5 Claims, 6 Drawing Figures

CABINET FOR USE IN MOBILE VEHICLE

MOBILE DISPENSARY FOR PIECE GOODS

This invention relates to a cabinet for use in a mobile van or truck to store piece goods.

Closed vans are often provided with shelves along their side walls to store piece goods such as spare parts for availability when making service calls, for instance for furnace maintenance and repair. To stock the van the parts are placed on the shelves individually and by hand. It has been proposed to use this concept to deliver office supplies but the amount of labor used in handling the merchandise makes the operation only marginally profitable at best.

It is an object of the present invention to provide a cabinet, for use in a mobile van or truck, which receives pre-packed trays arranged in vertical series and operable as drawers, the trays being removable from the cabinet for repacking.

Essentially the invention consists of a cabinet, for use in a mobile van or truck, comprising: a rectangular frame having vertical legs interconnected by horizontal struts; at least one extensible drawer suspension means mounted on the frame, said means including a pair of opposed extensible channel-shaped runners each having a plurality of hook means projecting laterally therefrom; at least one tray having a pair of opposed sides with bar means fixed horizontally parallel to each side and spaced therefrom, the bar means being engagable with the hook means of the opposed runners whereby the tray is removably carried by the suspension means; and releasable means to hold the tray in closed position in the frame with the suspension means retracted.

An example embodiment of the invention is shown in the accompanying drawings in which.

Figure 3:
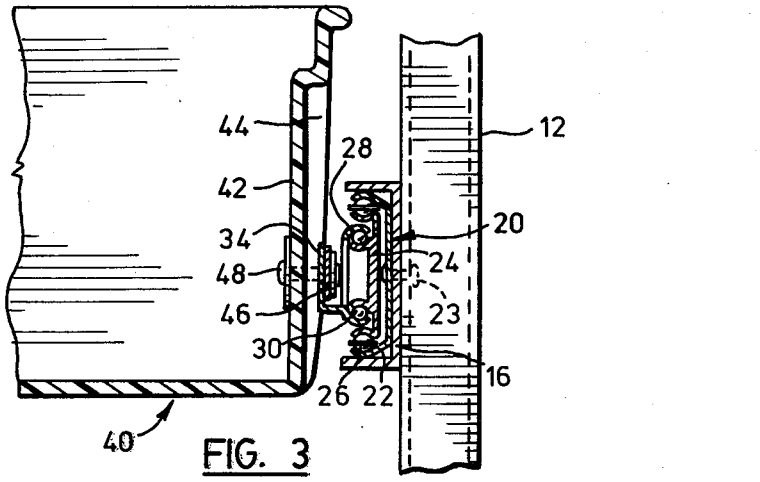
FIG. 3 is a cross-sectional view taken along line 3—3 of FIG. 1.

The example embodiment shown in the drawings consists of a rectangular rack or frame 10 having four vertical tubular legs 12 joined by horizontal struts 14. Pairs of opposed horizontal channels 16 are fixed one above the other in spaced relationship on the inwardly facing sides of opposed pairs of legs 12 of frame 10.

Figures 4, 5:
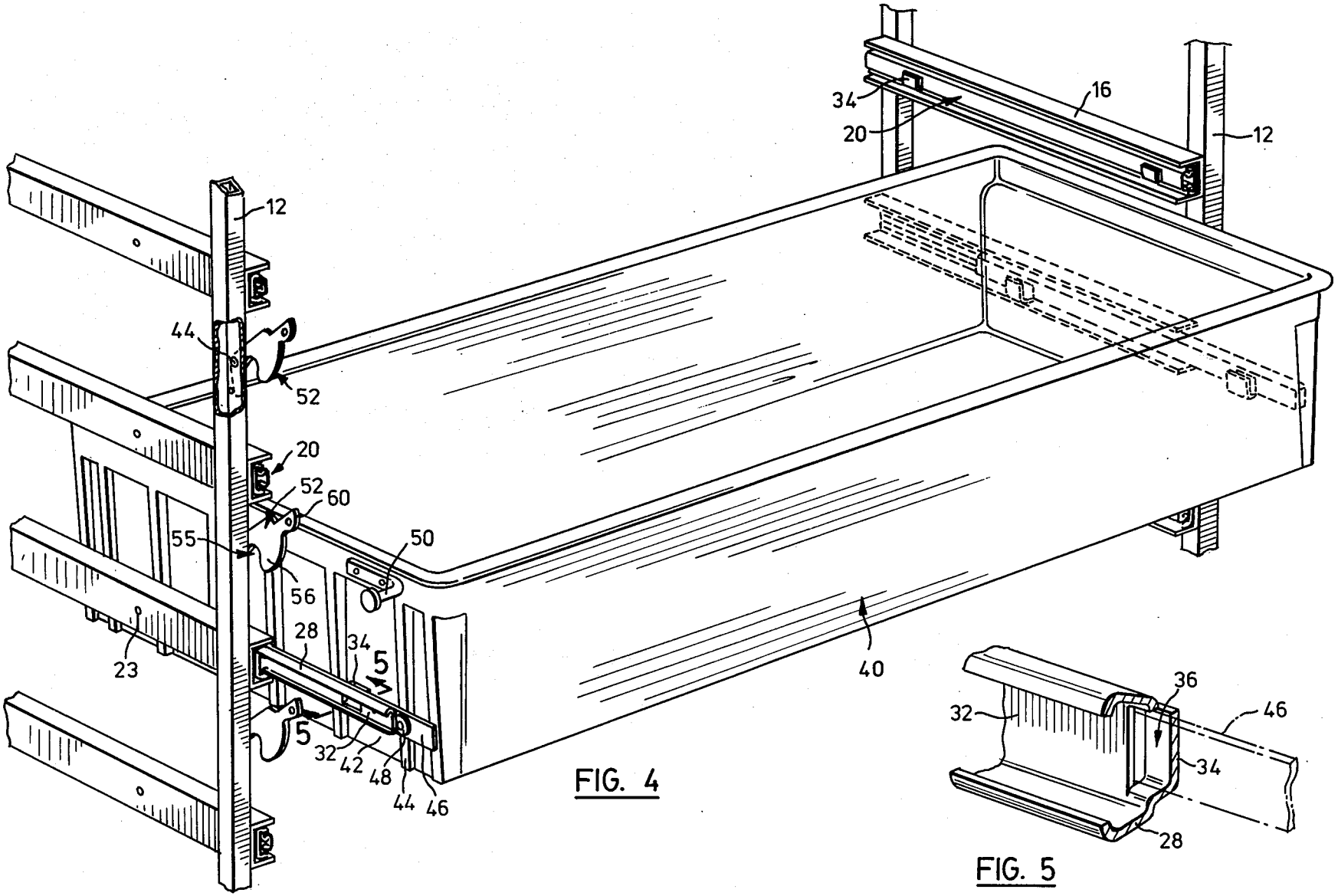
FIG. 4 is a perspective view of a portion of the cabinet of FIG. 1 showing one of the trays in greater detail.
FIG. 5 is a cross-sectional view taken along line 5—5 of FIG. 4.

Fixed within each channel 16 is an extensible drawer suspension mechanism 20, known as a full drawer suspension, having a channel 22 fixed within channel 16 by rivets 23, a first runner 24 slidable longitudinally on channel 22 on bearings 26, and a second runner 28 slidable longitudinally on first runner 24 on bearings 30. Second runner 28 is channel-shaped with a base 32 which faces outwardly from channel 16. Base 32 of channel 28 carries hook means in the form of a plurality of spaced flanges 34, preferably two, projecting outwardly and upwardly from the base of the channel, as seen in FIG. 5 of the drawings, to form slotted pockets 36. Flanges 34 may be pressed outwardly from base 32 of runner 28 as shown.

A plurality of trays 40, which are preferably made of structural foam, are associated one with each pair of opposed channels 16. Each tray 40 is rectangular with end walls 42 having a plurality of outwardly extending spaced vertical ribs 44. A horizontal bar 46 is fastened, preferably by rivets 48, to at least two of ribs 44 on each end wall 42. The thickness of each bar 46 allows it to rest in pockets 46 of adjacent runner 28 with flanges 34 located between ribs 44 of tray 40.

Figure 6:
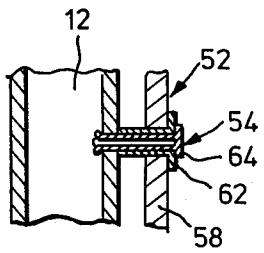
FIG. 6 is a cross-sectional view of the rivet assembly of the latch taken along line 6—6 of FIG. 2.

A laterally projecting striker pin 50 is fixed on the upper, forward portion of one end wall 42 of tray 40. A toggle 52 is pivotally attached by a rivet assembly 54 to the adjacent front leg 12 of frame 10. Toggle 52 has a recess 55 defined by a front leg 56 and a rear leg 58. Rivet assembly 54 passes through rear lug 58 which bears against a laterally projecting stop 59 fixed on leg 12. A forwardly projecting lug 60 has an indent 61 to bear against the end of channel 16. Rivet assembly 54, as seen in FIG. 6, consists of a first hollow rivet 62 passing through toggle 52 to bear against leg 12, and a second rivet 64 passing through the hollow shank of rivet 62 and through one wall of leg 12, allowing rivet 64 to rotate within rivet 62.

The lower portions of legs 12 carry adjustable telescopic ends 66 with removable pins 67 allowing frame 10 to rest on an uneven van floor. The upper portion of frame 10 is attached to a stringer 68 fixed to the side wall of the van. A number of frames 10 may be attached to stringer 68 to fill the van wall. The top portion of frame 10 may have a shelf 70 and a door 72 pivotally mounted by hinges 74 to top horizontal front strut 14.

Figure 2:
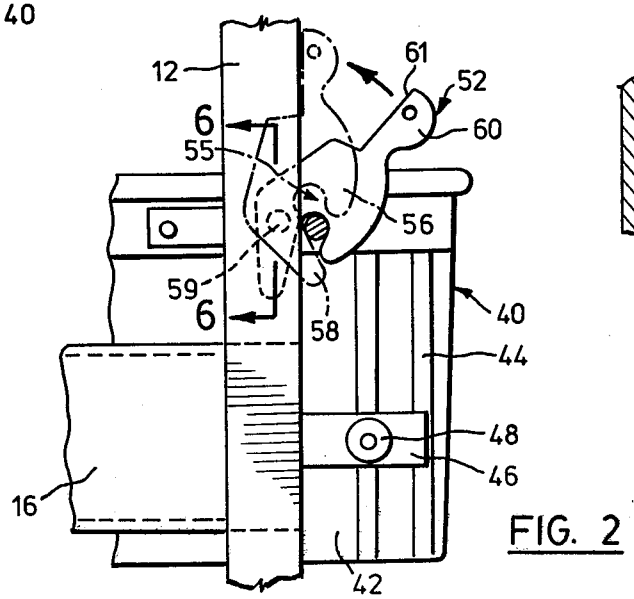
FIG. 2 is a side view taken along line 2—2 of FIG. 1.
Figure 1:
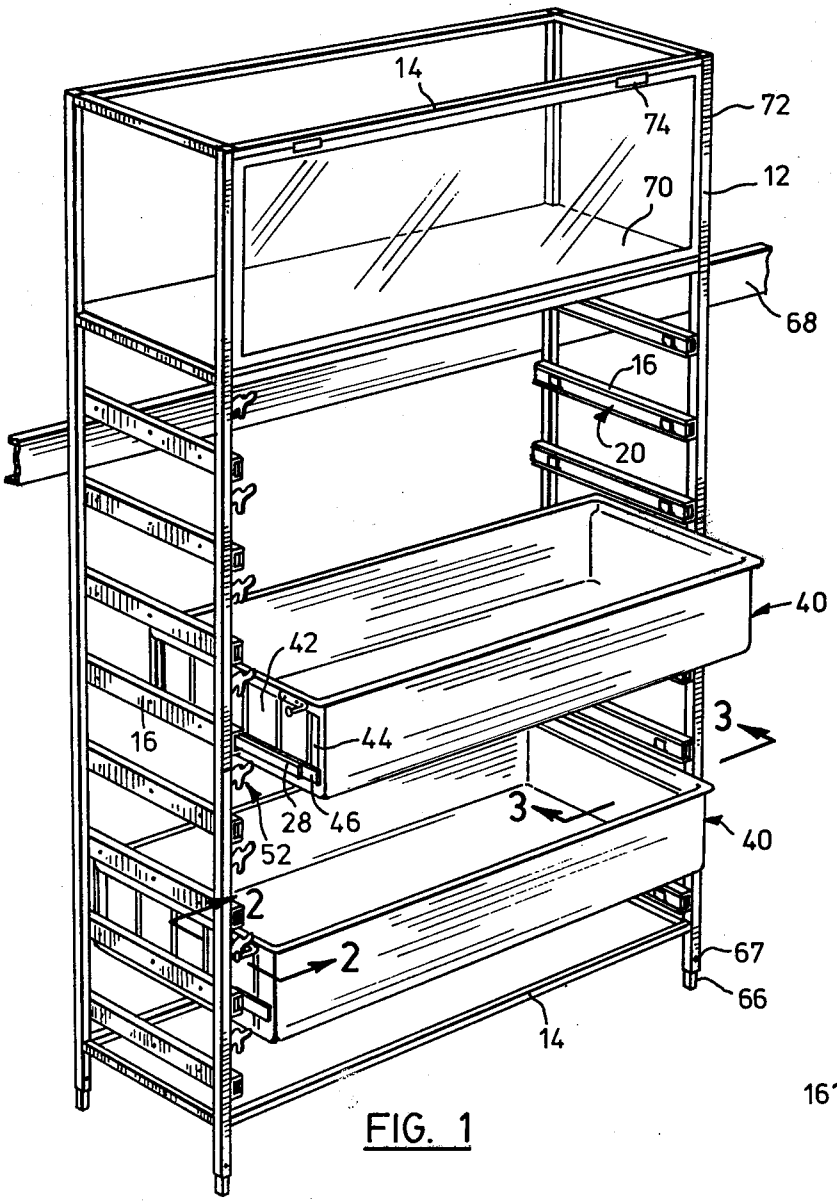
FIG. 1 is a perspective view of a storage cabinet showing two trays mounted thereon, one tray being in partially opened position.

In the operation of the example embodiment a tray 40 is pre-packed and carried to frame 10. Suspension mechanisms 20 of a pair of opposed channels 18 are extended fully. Tray 40 is positioned between extended runners 28 and lowered to locate bars 46 in pockets 36, whereupon the tray may be operated as a drawer and closed. As the tray is closed pin 50 meets front lug 56 of toggle 52 which is inclined forwardly by gravity to bear against stop 60, forcing toggle 52 upwardly and striking rear lug 58 of the toggle, whereupon the toggle drops over the pin which passes into recess 55 where it is held. To unlatch tray 40 thumb pressure is applied against lug 60 to pivot toggle 52 upwardly as seen in FIG. 2, and the tray, acting as a drawer, may be opened. When in fully open position tray 40 may be lifted from suspension mechanisms 20.

I claim:

1. A cabinet, for use in a mobile van or truck, comprising:

a rectangular frame having vertical legs interconnected by horizontal struts;

at least one extensible drawer suspension means mounted on the frame, said means including a pair of opposed extensible channel-shaped runners each having a plurality of hook means projecting laterally therefrom;

at least one tray having a pair of opposed sides with bar means fixed horizontally parallel to each side and spaced therefrom, the bar means being engagable with the hook means of the opposed runners whereby the tray is removably carried by the suspension means; and releaseable means to hold the tray in closed position in the frame with the suspension means retracted.

2. A cabinet as claimed in claim 1 in which the releasable means comprises a latch having a toggle pivotally mounted on the frame and engagable with a pin fixed on the tray.

3. A cabinet as claimed in claim 1 in which lower ends of the legs of the frame are telescopically adjustable.

4. A cabinet as claimed in claim 1 in which the tray is of structural foam plastic with a plurality of spaced vertical ribs on said opposed sides, the horizontal bar means being fixed to the ribs.

5. A cabinet as claimed in claim 1 in which the hook means each comprises a flange projecting laterally from the runner to form a slotted pocket.

* * * * *